US007891414B2

(12) United States Patent
Cheng et al.

(10) Patent No.: US 7,891,414 B2
(45) Date of Patent: Feb. 22, 2011

(54) METHOD FOR MANUFACTURING HEAT DISSIPATOR HAVING HEAT PIPES AND PRODUCT OF THE SAME

(75) Inventors: Chih-Hung Cheng, Wugu Township, Taipei County (TW); Ken Hsu, Wugu Township, Taipei County (TW)

(73) Assignees: Golden Sun News Techniques Co., Ltd., Taipei (TW); Cpumate Inc., Taipei (TW)

( * ) Notice: Subject to any disclaimer, the term of this patent is extended or adjusted under 35 U.S.C. 154(b) by 816 days.

(21) Appl. No.: 11/863,583

(22) Filed: Sep. 28, 2007

(65) Prior Publication Data

US 2009/0084528 A1 Apr. 2, 2009

(51) Int. Cl.
*H05K 7/20* (2006.01)

(52) U.S. Cl. ..... 165/104.33; 29/890.032; 361/700

(58) Field of Classification Search ..... 165/104.33; 361/700
See application file for complete search history.

(56) References Cited

U.S. PATENT DOCUMENTS 6,853,555 B2 * 2/2005 Fichera et al. ..... 361/700
7,600,558 B2 * 10/2009 Chen ..... 165/80.3
7,661,461 B2 * 2/2010 Chen ..... 165/80.3
2005/0161199 A1 * 7/2005 Ma et al. ..... 165/104.33
2005/0180110 A1 * 8/2005 I-Yung et al. ..... 361/700
2007/0056713 A1 * 3/2007 Chiriac et al. ..... 165/104.26
2007/0127209 A1 * 6/2007 Lopatinsky et al. ..... 361/700
2007/0144709 A1 * 6/2007 Lee et al. ..... 165/104.33
2007/0215327 A1 * 9/2007 Lai et al. ..... 165/104.33
2007/0261822 A1 * 11/2007 Lin et al. ..... 165/104.33
2007/0267181 A1 * 11/2007 Lin et al. ..... 165/104.33

* cited by examiner

*Primary Examiner*—Allen J Flanigan
(74) *Attorney, Agent, or Firm*—Chun-Ming Shih; HDLS IPR Services

(57) ABSTRACT

A heat dissipator having heat pipes includes a heat-conducting base, a first heat pipe and a second heat pipe. The heat-conducting base has an accommodating trough. After the first heat pipe is accommodated in the accommodating trough, it is deformed so as to abut against the inner wall face of the accommodating trough. Further, the second heat pipe and the first heat pipe are provided in the same accommodating trough, and the second heat pipe is overlapped vertically on the first heat pipe. As a result, the second heat pipe is deformed so as to abut against the first heat pipe and the interior of the accommodating trough, thereby enhancing the heat-conducting performance of the heat dissipator.

7 Claims, 5 Drawing Sheets

METHOD FOR MANUFACTURING HEAT DISSIPATOR HAVING HEAT PIPES AND PRODUCT OF THE SAME

BACKGROUND OF THE INVENTION

1. Field of the Invention

The present invention relates to a heat-dissipating device, and in particular to a method for manufacturing a heat dissipator having heat pipes and a product of the same.

2. Description of Prior Art

The electronic products of modern technical industries are made more and more precise, and thus the volume thereof is miniaturized. In addition, the heat generated by these electronic products also increases to a large extent. Since excessive heat may affect the working performance and the lifetime of the electronic product directly, additional heat-dissipating devices are needed in order to allow the electronic product to operate normally in an acceptable range of working temperature, thereby reducing the adverse influence of the heat on the operation of the electronic product.

Owing to the tendency to pursue a small-sized and light construction, the heat-dissipating device that is most often used is a heat dissipator having heat pipes. The heat dissipator is made of materials having high coefficient of heat conductivity. With the operation of a working fluid and a capillary structure provided within the heat pipe, the heat dissipator has a property of high heat conductivity and also has an advantage of light weight, thereby reducing the problems such as the noise, weight and cost generated by the heat-dissipating device and the complexity of the system. Therefore, it is possible to transmit a large amount of heat source without consuming electricity, and thus the heat dissipator having heat pipes has become one of the popular heat-dissipating assemblies.

In prior art, the structure of the heat dissipator having heat pipes includes a heat-conducting base and a plurality of heat pipes. These heat pipes are arranged at intervals on the heat-conducting base. After the heat-conducting base absorbs the heat from a heat-generating element, the heat can be conducted to heat-dissipating bodies connected to the heat pipes via the transaction of the capillary structure and the working fluid within the heat pipes. In this way, the heat-dissipating action can be performed to the heat-generating element.

However, since the amount of heat generated by the heat-generating element has developed to an unanticipated extent, and the heat capacity of the capillary structure and working fluid within single heat pipe is fixed, excessive heat may cause the working fluid within the heat pipe to be vaporized and thus cannot circulate therein, so that the heat conduction of the heat pipe totally fails. Although a plurality of sets of heat pipes are provided on one heat dissipator, the heat absorbed by the heat-conducting base cannot be distributed to each heat pipe uniformly, and thus the problem of vaporizing the working fluid within the heat pipe still exists. Therefore, in view of the above problems, it is necessary to improve the original structure.

SUMMARY OF THE INVENTION

In view of the above drawbacks, the present invention provides a method for manufacturing a heat dissipator having heat pipes and a product of the same. With a plurality of heat pipes overlapped on the same position, the plurality of heat pipes that are arranged on the same position can absorb the heat at the same time, thereby avoiding the heat from exceeding the workload of single heat pipe and keeping the heat-dissipating efficiency of the heat dissipator.

The present invention provides a heat dissipator having heat pipes, which includes a heat-conducting base, a first heat pipe and a second heat pipe. The heat-conducting base has an accommodating trough. After the first heat pipe is accommodated in the accommodating trough, it is deformed so as to abut against the inner wall face of the accommodating trough. Further, the second heat pipe and the first heat pipe are provided in the same accommodating trough, and the second heat pipe is overlapped vertically on the first heat pipe. As a result, the second heat pipe is deformed so as to abut against the first heat pipe and the interior of the accommodating trough, thereby enhancing the heat-conducting performance of the heat dissipator.

The present invention provides a method for manufacturing a heat dissipator having heat pipes, comprising the steps of:

a) arranging a heat pipe in the accommodating trough;
b) pressing the heat pipe to generate deformation, thereby causing the heat pipe to abut against the inner wall face of the accommodating trough;
c) arranging another heat pipe in the accommodating trough to overlap on the above heat pipe; and
d) pressing the another heat pipe to generate deformation, thereby causing the another heat pipe to abut against the above heat pipe and the interior of the accommodating trough.

DETAILED DESCRIPTION OF THE INVENTION

The technical contents of the present invention will be described with reference to the accompanying drawings.

Figure 1:
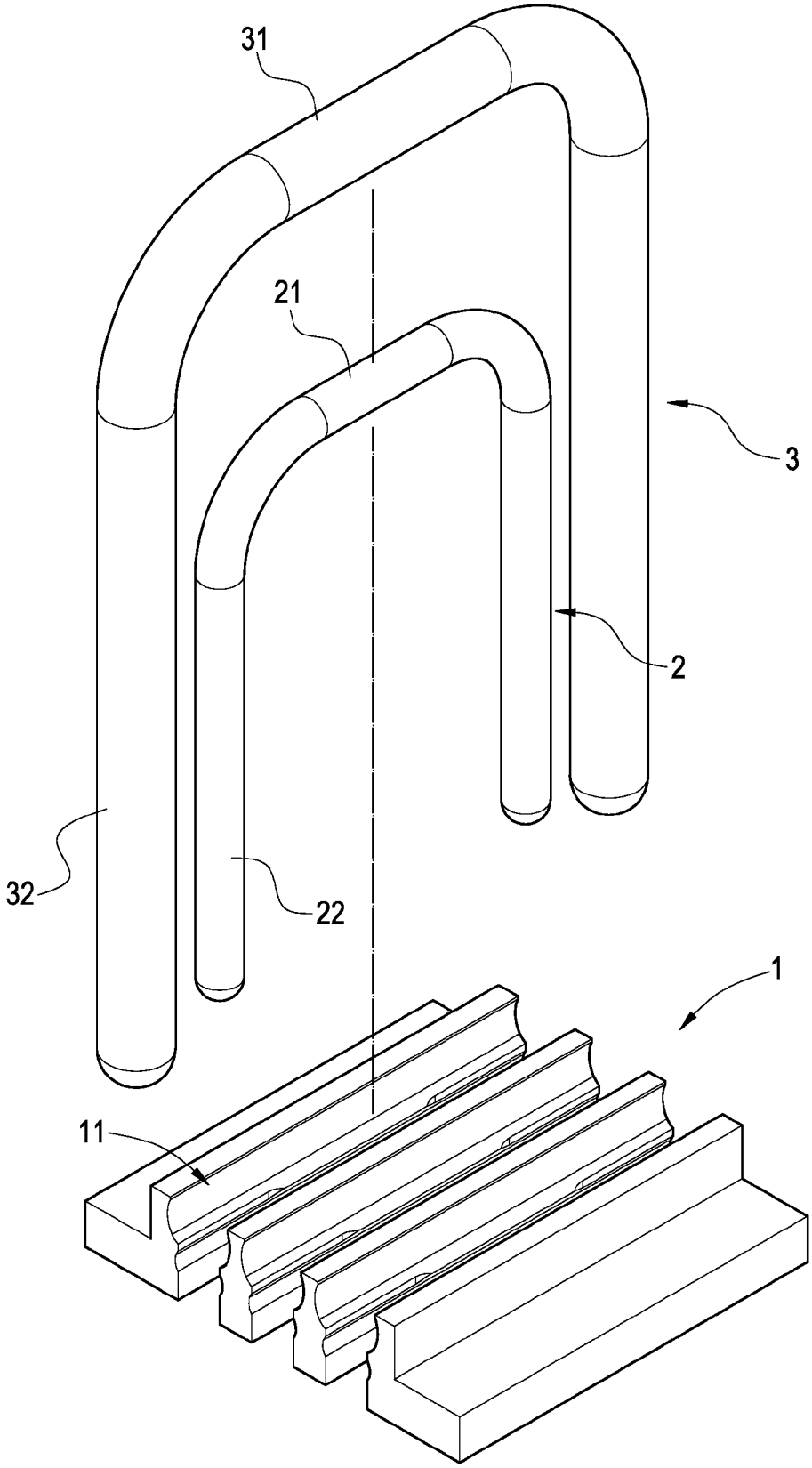
FIG. 1 is an exploded perspective view of the present invention.
Figure 2:
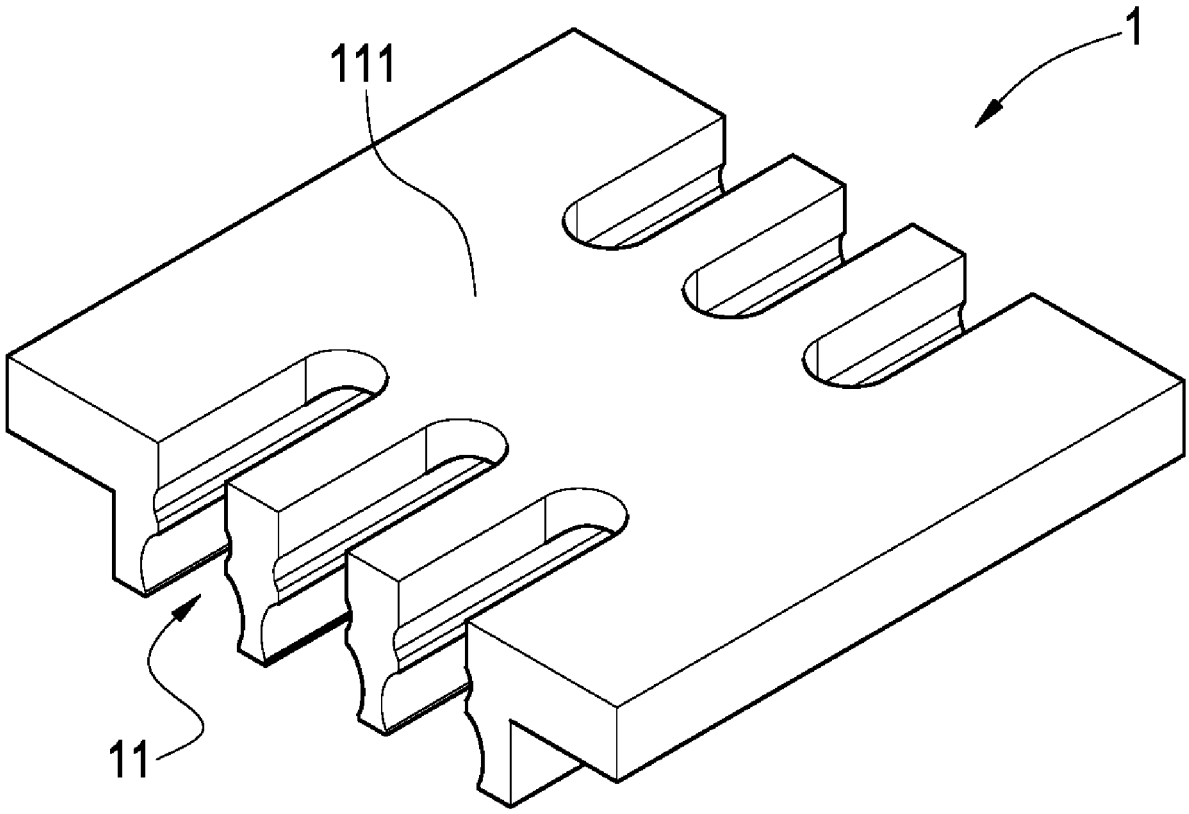
FIG. 2 is a rear view of the heat-conducting base of the present invention.

FIG. 1 is an exploded perspective view of the present invention, and FIG. 2 is a rear view thereof. As shown in these figures, the heat dissipator having heat pipes includes a heat-conducting base 1, a first heat pipe 2 and a second heat pipe 3. The heat-conducting base 1 is made of materials having high heat conductivity. The heat-conducting base 1 is provided thereon with at least one accommodating trough 11. The accommodating trough 11 as a bottom surface defining an abutting section 111, an opening opposite the bottom surface, and side surfaces defining inner wall faces extending therebetween. The first heat pipe 2 is pressed against/contacts the bottom surface/abutting section 111, while the second heat pipe 3 is pressed against the first heat pipe 2 so as to partially cover the first heat pipe 2, such that the first heat pipe 2 is disposed between the bottom surface and the second heat pipe 3, and the second heat pipe 3 is disposed between the first heat pipe 2 and the trough opening. In the present embodiment, there is a plurality of accommodating troughs 11. Both sides of each accommodating trough 11 penetrate the heat-conducting base 1 and extend toward the middle, so that the center of the bottom of the accommodating trough 11 is formed with an abutting section 111 as shown in FIG. 2. Further, the first heat pipe 2 and the second heat pipe 3 are provided in such a manner that they are overlapped vertically in the same accommodating trough 11 of the heat-conducting base 1. In the present embodiment, the diameter of the second heat pipe 3 is larger than that of the first heat pipe 2. The first heat pipe 2 and the second heat pipe 3 are each formed into a U-lettered shape. The curved portion of the first heat pipe 2 is used as a heat-absorbing section 21. Both ends of the first heat pipe 2 are condensing sections 22. After the heat pipe 2 is accommodated in the accommodating trough 11, the heat-absorbing section 21 abuts against the abutting section 111 directly, and thus is deformed to become flat (as shown in the cross-sectional view of FIG. 8, which will be described in detail later). The condensing sections 22 of the first heat pipe 2 penetrate through the heat-conducting base 1. Further, the curved portion of the second heat pipe 3 also has a heat-absorbing section 31, and both ends thereof are condensing sections 32. After the second heat pipe 3 is accommodated in the accommodating trough 11, the heat-absorbing section 31 abuts on the heat-absorbing section 21 of the first heat pipe 2, and thus is deformed to become flat (as shown in the cross-sectional view of FIG. 8, which will be described in detail later). In this way, the heat dissipator having heat pipes can be constituted completely.

Next, the method for manufacturing the heat dissipator having heat pipes will be described with reference to a plurality of continuous figures.

Figure 3:
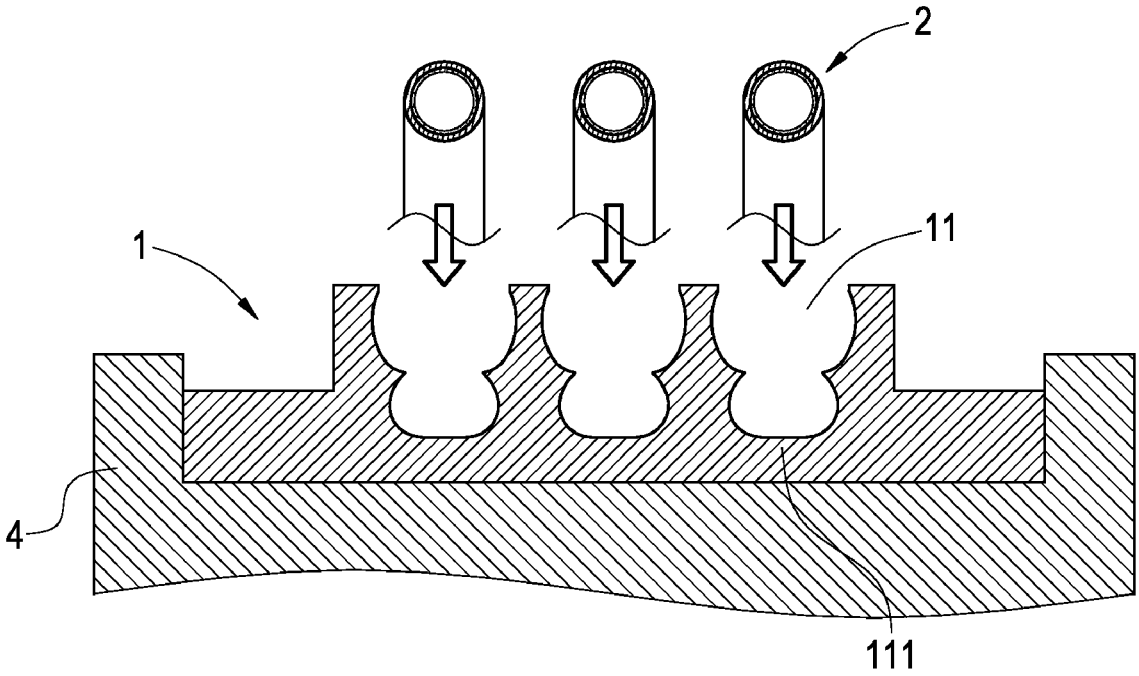
FIGS. 3 to 7 are flowcharts showing the manufacturing procedure of the present invention.
Figure 4:
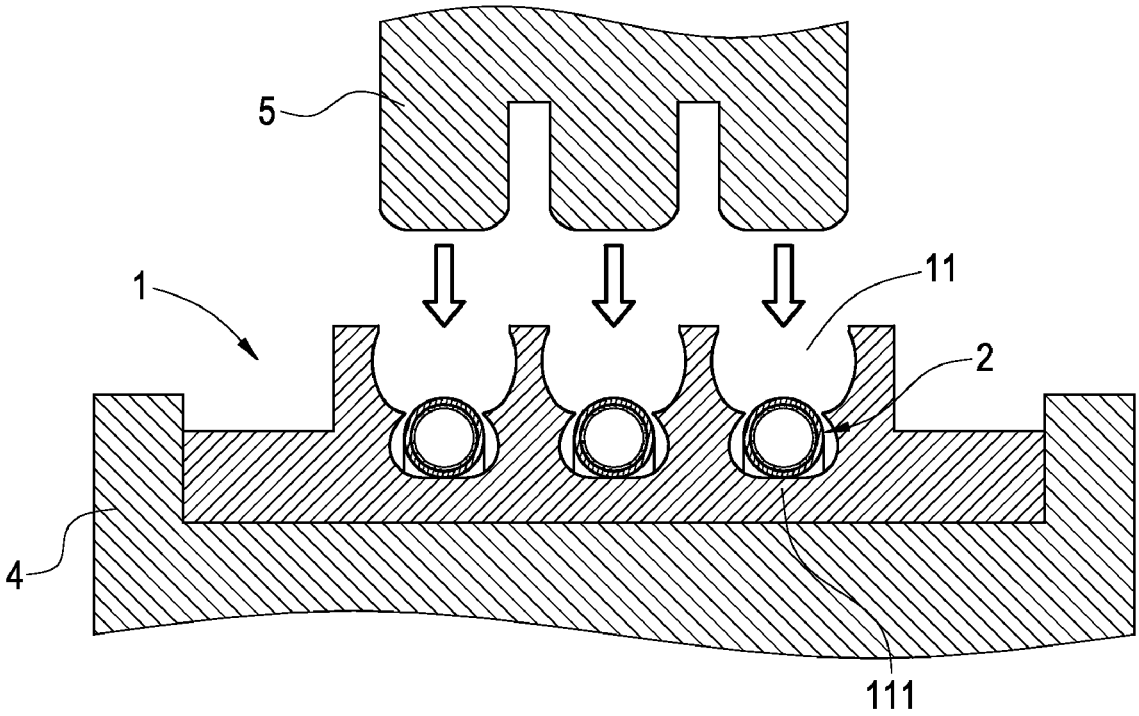
Figure 5:
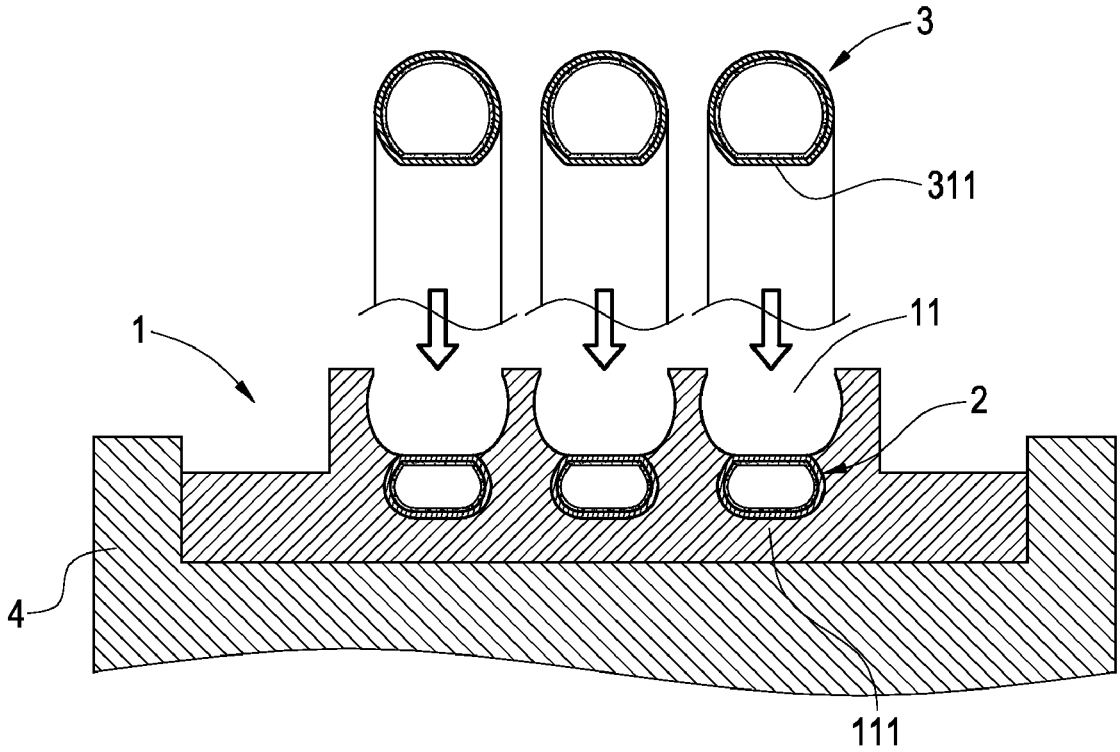
Figure 6:
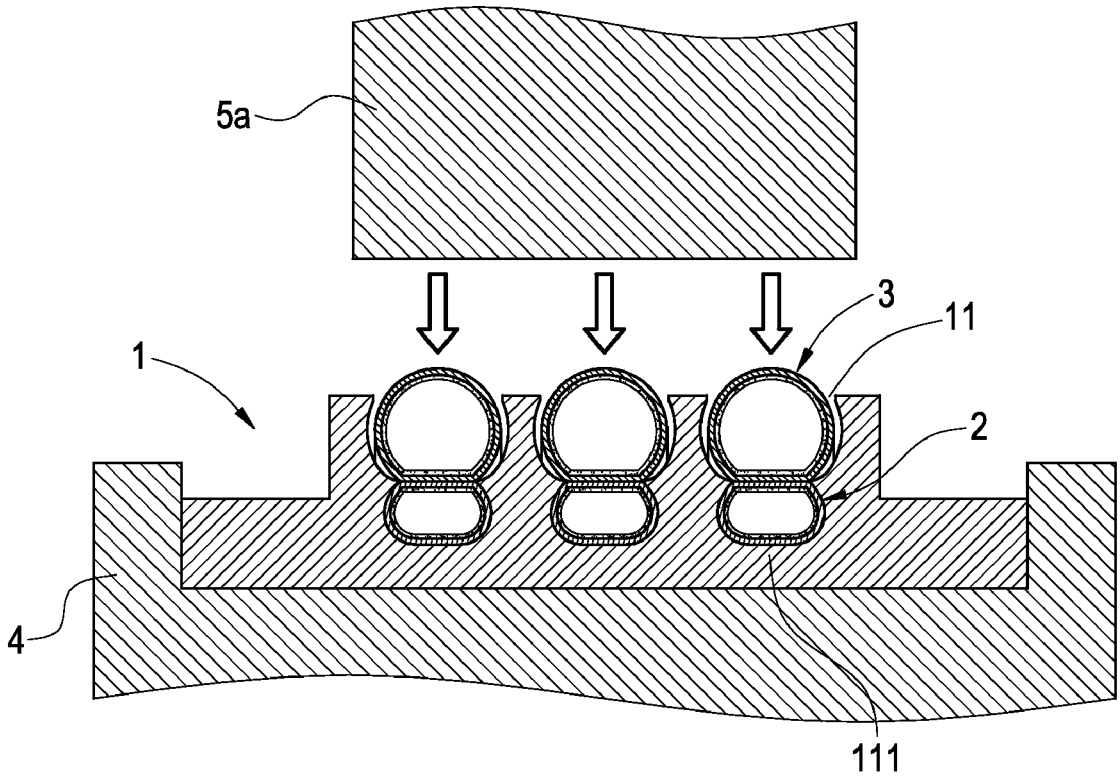
Figure 7:
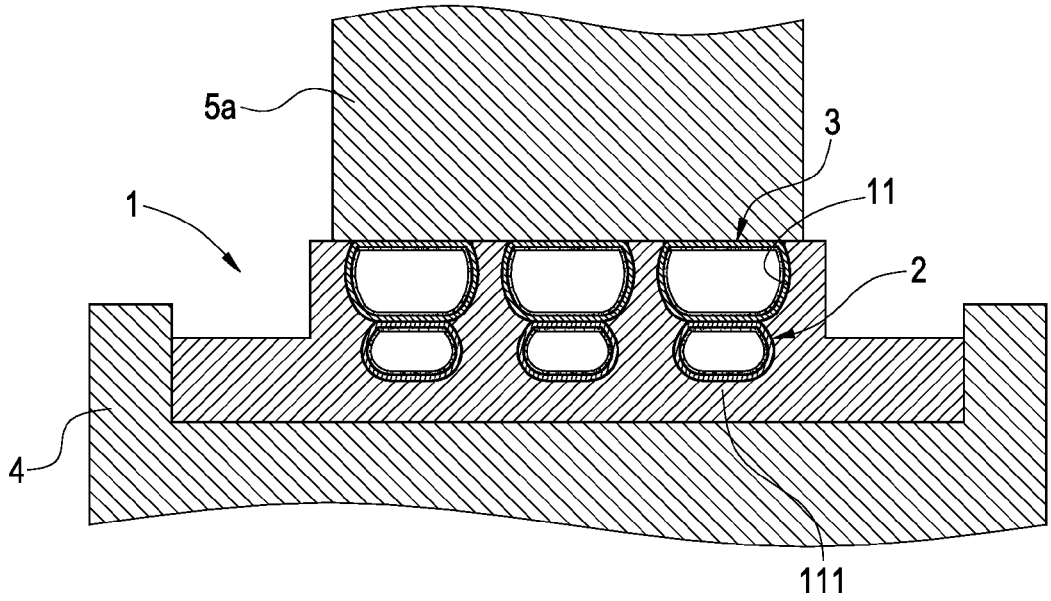
Figure 8:
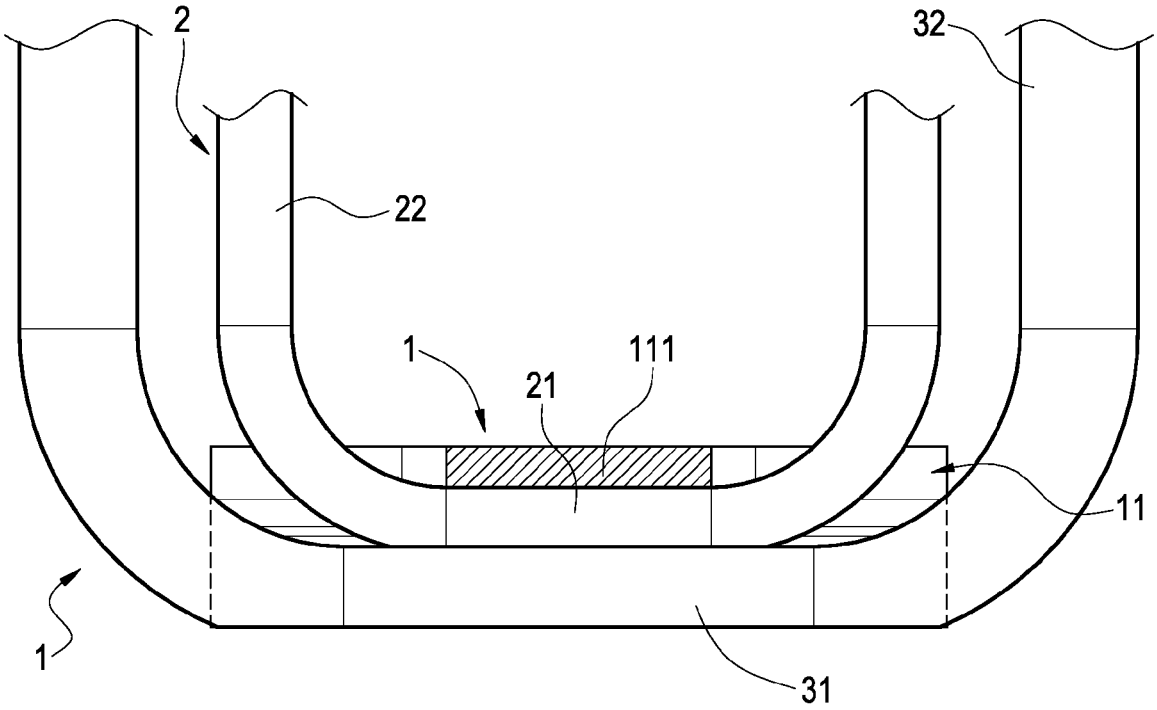
FIG. 8 is a cross-sectional view showing the complete assembly of the present invention.

As shown in FIG. 3, a heat-conducting base 2 is provided. The heat-conducting base 1 is disposed on a platform 4. Further, a plurality of first heat pipes 2 is provided. These first heat pipes 2 are disposed in the accommodating troughs 11 of the heat-conducting base 1, so that the heat-absorbing section 21 of each first heat pipe 2 abuts against the abutting section 111 of the accommodating trough 11. Then, a mold 5 is provided. As shown in FIG. 4, the mold 5 is used to press the first heat pipes 2 accommodated in the accommodating troughs 11, so that the heat-absorbing section 21 of each first heat pipe 2 is deformed to abut against the inner wall face of the accommodating trough 11. Further, a plurality of second heat pipes 3 is provided. The inside of the heat-absorbing section 31 of the heat pipe 3 is pressed to form a plane 311 in advance, as shown in FIG. 5. Then, these second heat pipes 3 are disposed in the accommodating troughs 11, so that the plane 311 of each second heat pipe 3 is overlapped on the back surface of the first heat pipe 2. Then, another mold 5*a* is provided. As shown in FIG. 6, the mold 5*a* is used to press these second heat pipes 3, so that each of these second heat pipes 3 is deformed to abut against the inner wall face of the accommodating trough 11 and the heat-absorbing section 21 of the first heat pipe 2. As shown in FIG. 7, at the same time, the second heat pipe 3 is flush with the bottom of the heat-conducting base 1. The complete assembly of the present invention is shown in FIG. 8.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A method of manufacturing a heat dissipator having heat pipes, for assembling the heat pipes in a same accommodating trough of a heat-conducting base, the method comprising the steps of:

a) arranging a first heat pipe in the accommodating trough, the accommodating trough having a bottom surface defining an abutting section, an opening opposite the bottom surface, and side surfaces defining inner wall faces extending therebetween;

b) pressing the first heat pipe to generate deformation, thereby causing the first heat pipe to be pressed against the bottom surface and contacts the abutting section;

c) arranging second heat pipe in the accommodating trough to overlap on the first heat pipe; and d) pressing the second heat pipe to generate deformation, thereby causing the second heat pipe to be pressed against the first heat pipe so as to partially cover the first heat pipe, such that the first heat pipe is disposed between the bottom surface and the second heat pipe, and the second heat pipe is disposed between the first heat pipe and the trough opening.

2. The method according to claim 1, wherein in the step c), one side of the second heat pipe is formed with a plane, the plane being caused to abut on the first heat pipe.

3. A heat dissipator having heat pipes, comprising:

a heat-conducting base having an accommodating trough thereon, wherein the accommodating trough has a bottom surface defining an abutting section, an opening opposite the bottom surface, and side surfaces defining inner wall faces extending therebetween;

a first heat pipe accommodated in the accommodating trough to abut against the interior of the accommodating trough;

a second heat pipe also accommodated in the accommodating trough and overlapped on the first heat pipe to abut against the first heat pipe and the interior of the accommodating trough, wherein the first heat pipe is pressed against the bottom surface and contacts the abutting section, while the second heat pipe is pressed against the first heat pipe so as to partially cover the first heat pipe, such that the first heat pipe is disposed between the bottom surface and the second heat pipe, and the second heat pipe is disposed between the first heat pipe and the trough opening.

4. A heat dissipator having heat pipes, comprising:

a heat-conducting base having an accommodating trough thereon;

a first heat pipe accommodated in the accommodating trough to abut against the interior of the accommodating trough;

a second heat pipe also accommodated in the accommodating trough and overlapped on the first heat pipe to abut against the first heat pipe and the interior of the accommodating trough, wherein the diameter of the outer edge of the second heat pipe is larger than that of the first heat pipe.

5. The heat dissipator having heat pipes according to claim 3, wherein the first heat pipe has a heat-absorbing section, and the heat-absorbing section abuts against the abutting section.

6. The heat dissipator having heat pipes according to claim 5, wherein the second heat pipe has a heat-absorbing section, and the heat-absorbing section abuts on the heat-absorbing section of the first heat pipe.

7. The heat dissipator having heat pipes according to claim 3, wherein the first heat pipe and the second heat pipe are each formed into a U-lettered shape.

* * * * *